US010580566B2

(12) United States Patent
Yang et al.

(10) Patent No.: US 10,580,566 B2
(45) Date of Patent: Mar. 3, 2020

(54) WINDING-TYPE INDUCTOR

(71) Applicant: SAMSUNG ELECTRO-MECHANICS CO., LTD., Suwon-si, Gyeonggi-do (KR)

(72) Inventors: Ju Hwan Yang, Suwon-si (KR); Yong Sam Lee, Suwon-si (KR); Young Seuck Yoo, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 162 days.

(21) Appl. No.: 15/961,291

(22) Filed: Apr. 24, 2018

(65) Prior Publication Data

US 2019/0180911 A1 Jun. 13, 2019

(30) Foreign Application Priority Data

Dec. 7, 2017 (KR) ..... 10-2017-0167355

(51) Int. Cl.

| | |
|---|---|
| ***H01F 27/02*** | (2006.01) |
| ***H01F 27/28*** | (2006.01) |
| ***H01F 27/29*** | (2006.01) |
| ***H01F 41/061*** | (2016.01) |
| ***H01F 27/255*** | (2006.01) |
| ***H01F 27/245*** | (2006.01) |
| ***H01F 17/00*** | (2006.01) |
| *H01F 17/04* | (2006.01) |

(52) U.S. Cl.

CPC ..... *H01F 27/28* (2013.01); *H01F 17/0006* (2013.01); *H01F 27/245* (2013.01); *H01F 27/255* (2013.01); *H01F 27/29* (2013.01); *H01F 27/292* (2013.01); *H01F 41/061* (2016.01); *H01F 2017/048* (2013.01)

(58) Field of Classification Search

CPC ..... H01F 41/061; H01F 27/29; H01F 27/28
USPC ..... 336/83, 90
See application file for complete search history.

(56) References Cited

U.S. PATENT DOCUMENTS

| | | | | |
|---|---|---|---|---|
| 9,087,634 | B2 * | 7/2015 | Sakamoto | H01F 41/02 |
| 9,607,752 | B2 * | 3/2017 | Kim | B22F 7/08 |
| 10,304,610 | B2 * | 5/2019 | Maeda | H01F 27/255 |
| 2003/0231077 | A1 | 12/2003 | Nuspl et al. | |
| 2014/0062638 | A1 * | 3/2014 | Sasamori | H01F 27/2847 336/175 |
| 2016/0307693 | A1 * | 10/2016 | Cho | H01F 17/04 |
| 2016/0322153 | A1 * | 11/2016 | Kawachi | H01F 27/2852 |
| 2016/0343501 | A1 * | 11/2016 | Suzuki | H01F 27/2828 |
| 2018/0182533 | A1 * | 6/2018 | Muneuchi | H01F 27/2828 |

FOREIGN PATENT DOCUMENTS

| | | | |
|---|---|---|---|
| JP | 2016-197764 | A | 11/2016 |
| KR | 10-1999-0066108 | A | 8/1999 |
| KR | 10-2005-0092246 | A | 9/2005 |
| KR | 10-2009-0099442 | A | 9/2009 |

* cited by examiner

*Primary Examiner* — Ronald Hinson
(74) *Attorney, Agent, or Firm* — Morgan, Lewis & Bockius LLP

(57) ABSTRACT

A winding-type inductor includes a body including a winding-type coil and first and second external electrodes disposed on external surfaces of the body. The body includes the winding-type coil, and first and second connection reinforcing portions are additionally arranged on first and second ends of the winding-type coil and directly connected to the first and second external electrodes.

10 Claims, 3 Drawing Sheets

WINDING-TYPE INDUCTOR

CROSS-REFERENCE TO RELATED APPLICATION

This application claims benefit of priority to Korean Patent Application No. 10-2017-0167355 filed on Dec. 7, 2017 in the Korean Intellectual Property Office, the disclosure of which is incorporated herein by reference in its entirety.

BACKGROUND

1. Field

The present disclosure relates to a winding-type inductor.

2. Description of Related Art

As electronic products have been increasingly miniaturized, reduced in thickness, and multi-functionalized, high current components have also been required as chip components. Also, inductors are used in various electronic devices and electric devices. Inductors may be classified as a winding-type inductor, a thin film inductor, and multilayer inductors. Thereamong, winding-type inductors are advantageous, in that compact chip components may be mass-produced by stacking magnetic sheets on and under a coil wound multiple times.

SUMMARY

An aspect of the present disclosure may provide a winding-type inductor, as a miniaturized chip component which may be mass-produced, in which a contact area between a winding coil and external electrodes are increased.

According to an aspect of the present disclosure, a winding-type inductor may include a body having a winding-type coil including a first end and a second end and first and second external electrodes disposed on external surfaces of the body and electrically connected to the winding-type coil. The first and second ends are exposed to the external surfaces of the body, and first and second connection reinforcing portions are disposed on the first and second ends, respectively. The first and second connection reinforcing portions are directly connected to the first and second external electrodes, respectively. End surfaces of the first and second connection reinforcing portions exposed to the external surfaces of the body have a shape in which a lower surface thereof is flat and an upper surface thereof is curved.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Exemplary embodiments of the present disclosure will now be described in detail with reference to the accompanying drawings.

Hereinafter, a winding-type inductor according to an exemplary embodiment in the present disclosure will be described but it is not limited thereto.

Figure 1:
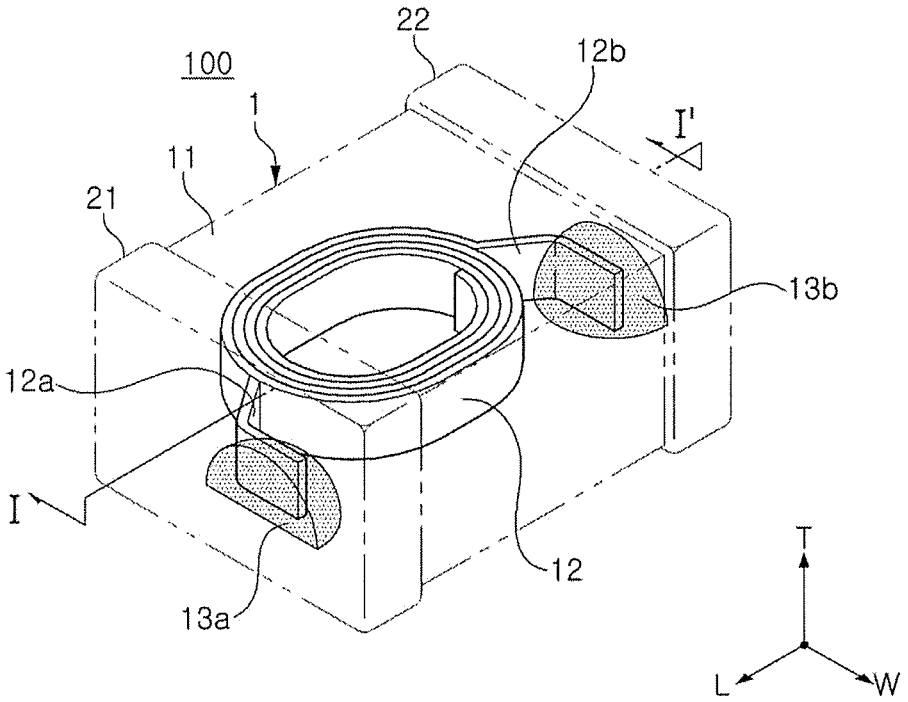
FIG. 1 is a schematic perspective view of an embodiment of a winding-type inductor according to an exemplary embodiment in the present disclosure.
Figure 2:
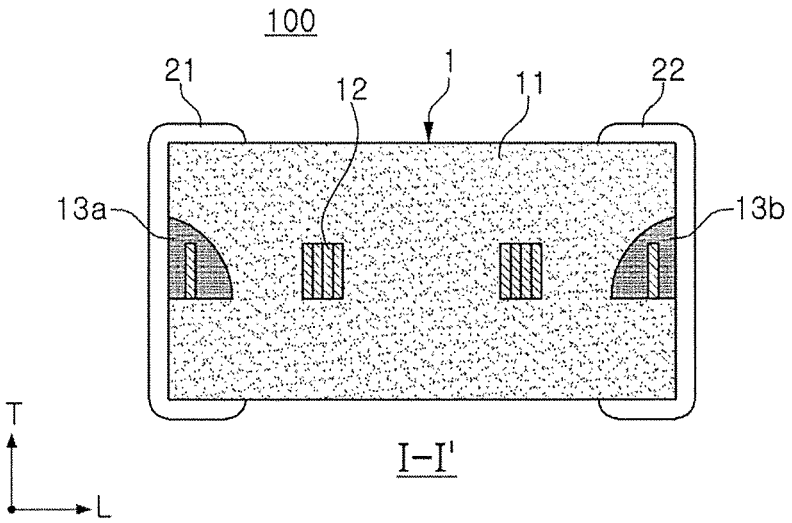
FIG. 2 is a schematic cross-sectional view taken along the line I-I' of FIG. 1.

FIG. 1 is a schematic perspective view of a winding-type inductor according to an exemplary embodiment in the present disclosure, and FIG. 2 is a schematic cross-sectional view taken along the line I-I' of FIG. 1.

Referring to FIGS. 1 and 2, a winding-type inductor 100 includes a body 1 and first and second external electrodes 21 and 22 on external surfaces of the body 1.

The body 1 may form an overall appearance of the winding-type inductor 100 and have an upper surface and a lower surface opposing in the thickness direction T, a first end surface and a second end surface opposing in the length direction L, and a first side surface and a second side surface opposing in the width direction W, having an overall hexahedral shape, but is not limited thereto.

The body 1 includes a stacked structure 11 formed by stacking a plurality of magnetic sheets. A direction in which the plurality of magnetic sheets are stacked substantially matches an axis direction of a magnetic core of a winding-type coil 12, and it may be the thickness direction T of the body with reference to FIGS. 1 and 2. However, this is merely an example, and the stacking direction in which the plurality of magnetic sheets are stacked may be appropriately set by those skilled in the art in consideration of process conditions and required specifications. In this case, the stacking structure including the plurality of magnetic sheets (not shown) forming the body 1 may be integrated such that boundaries therebetween may not be readily apparent without using a scanning electron microscope (SEM).

A material and structure of the magnetic sheets are not limited. For example, the magnetic sheets may be formed of a composite of a resin and a magnetic material such as magnetic powder, and here, the magnetic powder is dispersed in the resin. The magnetic powder may contain Fe, Cr, or Si as a main component, and specifically, it may be powder including Fe, Fe—Ni, Fe and Fe—Cr—Si. Also, the resin may include at least one of an epoxy, a polyimide, and a liquid crystal polymer. Here, the magnetic powder dispersed in the resin may have a bimodal form or bimodal size distribution including core-shell structure particles with the shell having fine grain size and the core having coarse grain size or magnetic powder particles having different sizes.

The winding-type coil 12 to be sealed by the stacking structure of the magnetic sheets of the body 1 will be described. The winding-type coil 12 includes first and second lead portions 12*a* and 12*b* that are led out in parallel in the length direction of the body 1. In some embodiments, the first and second lead portions 12*a* and 12*b* that are led out in the same direction (FIG. 1). In other embodiments, the first and second lead portions 12*a* and 12*b* that are led out in different directions such as opposite directions (not shown). A main body of the winding-type coil 12 is a coil wound by a general winding method. The winding method is not limited and may be appropriately set according to specifications required by those skilled in the art. The winding method may be, for example, flat-wise alpha winding or edge-wise winding.

First and second connection reinforcing portions 13*a* and 13*b* may be disposed in the first and second lead-out portions 12*a* and 12*b* of the winding-type coil 12, respectively. As the first and second connection reinforcing portions 13*a* and 13*b* are substantially exposed to the first and second end surfaces of the body 1, the first and second lead portions 12*a* and 12*b* of the winding-type coil 12 may be electrically connected to the first and second external electrodes 21 and 22.

Cross-sectional areas of the cross-sections of the first and second lead portions 12*a* and 12*b*, specifically, the cross-sectional areas in the plane including T and W directions are not generally large, and as a result, contact failure between the winding-type coil 12 and the external electrodes occurs frequent. Also, D.C. resistance Rdc at a contact interface between the winding-type coil 12 and the external electrodes is significantly large, making electrical characteristics poor. In this regard, however, since the first and second connection reinforcing portions 13*a* and 13*b* surrounding the end surfaces of the first and second lead portions 12*a* and 12*b* are provided in the winding-type inductor 100 according to an exemplary embodiment in the present disclosure, the problem of contact failure or increase in resistance of the contact interface may be solved.

Since ends of the first and second lead portions 12*a* and 12*b* are covered by the first and second connection reinforcing portions 13*a* and 13*b*, respectively, cross-sectional areas of the ends of the first and second lead portions 12*a* and 12*b* (the surfaces of the ends are facing the W direction in FIG. 1) are smaller than cross-sectional areas of the cross-sections of the first and second connection reinforcing portions 13*a* and 13*b* exposed to the external surfaces of the body 1. Accordingly, the first and second connection reinforcing portions 13*a* and 13*b* serve to increase a contact area between the first and second lead portions 12*a* and 12*b* and the first and second external electrodes 21 and 22.

Since the first and second connection reinforcing portions 13*a* and 13*b* also have a function of reducing resistance of the contact interface between the first and second lead portions 12*a* and 12*b* and the first and second external electrodes 21 and 22, the first and second connection reinforcing portions 13*a* and 13*b* may include a material substantially the same as a material of the winding-type coil 12. However, the material of the first and second connection reinforcing portions 13*a* and 13*b* is not limited thereto and may include any metal material having excellent electrical conductivity. For example, the first and second connection reinforcing portions 13*a* and 13*b* may include copper (Cu) as a main component.

Except for the exposed surfaces of the first and second connection reinforcing portions 13*a* and 13*b* exposed to the first and second end surfaces of the body 1, as end surfaces to be connected to the external electrodes 21 and 22, the entirety of upper and lower surfaces of the first and second connection reinforcing portions 13*a* and 13*b* are covered by the body 1 so as to be embedded in the body 1.

Referring to a shape of the exposed surfaces of the first and second connection reinforcing portions 13*a* and 13*b*, a lower surface of the exposed surface is flat, while an upper surface thereof is curved. Here, the exposed surfaces refer to surfaces parallel to the W-T surfaces which are diced during a chip cutting process. The upper surfaces of the first and second connection reinforcing portions 13*a* and 13*b* may be curved, are not limited in a radius of curvature, and may have a semicircular shape based on the flat lower surface as one edge.

Since the exposed surfaces of the first and second connection reinforcing portions 13*a* and 13*b* are substantially in contact with the first and second external electrodes 21 and 22, respectively, a contact surface between the winding-type coil 12 and the external electrodes 21 and 22 may be strengthened as the cross-sectional areas of the exposed surfaces, in the plane including T and W directions, are increased.

The first and second external electrodes 21 and 22 directly connected to the first and second connection reinforcing portions 13*a* and 13*b* will be described. In FIGS. 1 and 2, the first and second external electrodes 21 and 22 have a C-shaped structure, in a cross-sectional view along a cut line in a plane including L and T directions or L and W directions, connected from the first end surface and the second end surface to the upper surface and the lower surface of the body 1. However, the present disclosure is not limited thereto, and an external electrode having an L-shaped structure which does not extend to the upper surface of the body and a bottom electrode which extends only to the lower surface may also be configured.

Since the first and second external electrodes 21 and 22 are to be electrically connected to the winding-type coil 12, the first and second external electrodes 21 and 22 may include a metal having excellent electrical conductivity. Also, the first and second external electrodes 21 and 22 may include a plurality of layers, for example, an Ag-containing layer, a Ni-containing layer, and a Sn-containing layer in order from the innermost side. The plurality of layers may be appropriately selected by those skilled in the art, and thus, the Ni-containing layer may be selectively disposed on the innermost side of the first and second external electrodes 21 and 22 directly connected to the first and second connection reinforcing portions 13*a* and 13*b*, without the Ag-containing layer.

Figure 3:
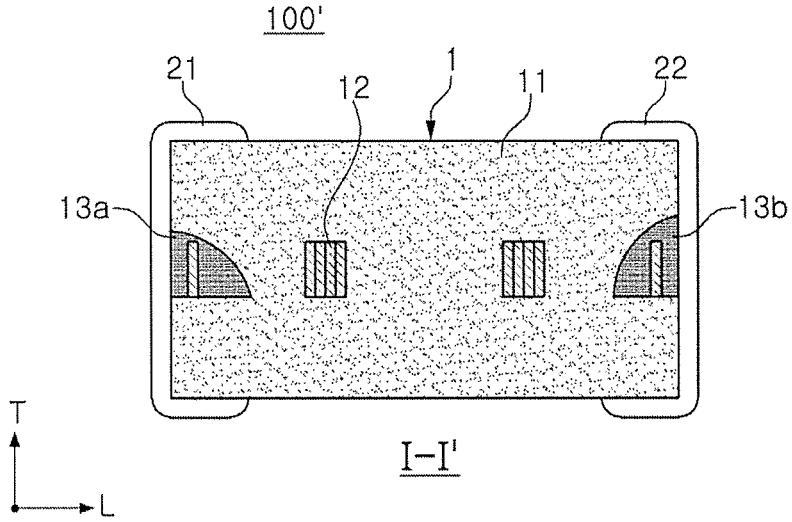
FIG. 3 is a schematic cross-sectional view of another embodiment of a winding-type inductor according to a modification of FIG. 2.

FIG. 3 is a schematic cross-sectional view of a winding-type inductor 100' according to a modification of FIG. 2. Compared with the winding-type inductor 100 of FIG. 2, the winding-type inductor 100' of FIG. 3 includes the substantially same components, except that only a cross-sectional area of an exposed surface of the first connection reinforcing portion 13*a* and a cross-sectional area of an exposed surface of the second connection reinforcing portion 13*b* are different. For the purposes of description, only the component differentiated from the winding-type inductor of FIG. 2 will be described and descriptions of the same components will be omitted. Also, the same reference numerals are used for the same components.

Referring to FIG. 3, a cross-sectional area of the exposed surface of the first connection reinforcing portion 13*a* is larger than a cross-sectional area of the exposed surface of the second connection reinforcing portion 13*b*. This means that the cross-sectional areas of the exposed surfaces may be differentiated by adjusting a position of a diced surface on the basis of the fact that the exposed surfaces of the first and second connection reinforcing portions 13*a* and 13*b* match diced surfaces. Differentiation of the cross-sectional area of the exposed surface of the first connection reinforcing portion 13*a* and the cross-sectional area of the exposed surface of the second connection reinforcing portion 13*b* may be appropriately set by those skilled in the art, and here, it may be selected in consideration of a material of the first and second external electrodes 21 and 22, whether the first and second external electrodes 21 and 22 include a plurality of layers, and an overall chip size of the winding-type inductor 100.

Figure 4A:
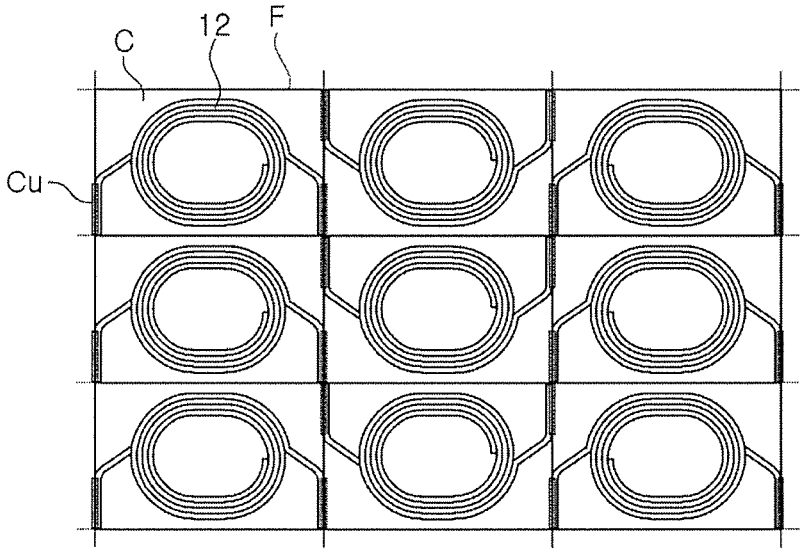
FIG. 4A is a view illustrating a process of arranging a plurality of winding-type coils on a frame during a manufacturing process of manufacturing the winding-type inductor of FIG. 1.
Figure 4B:
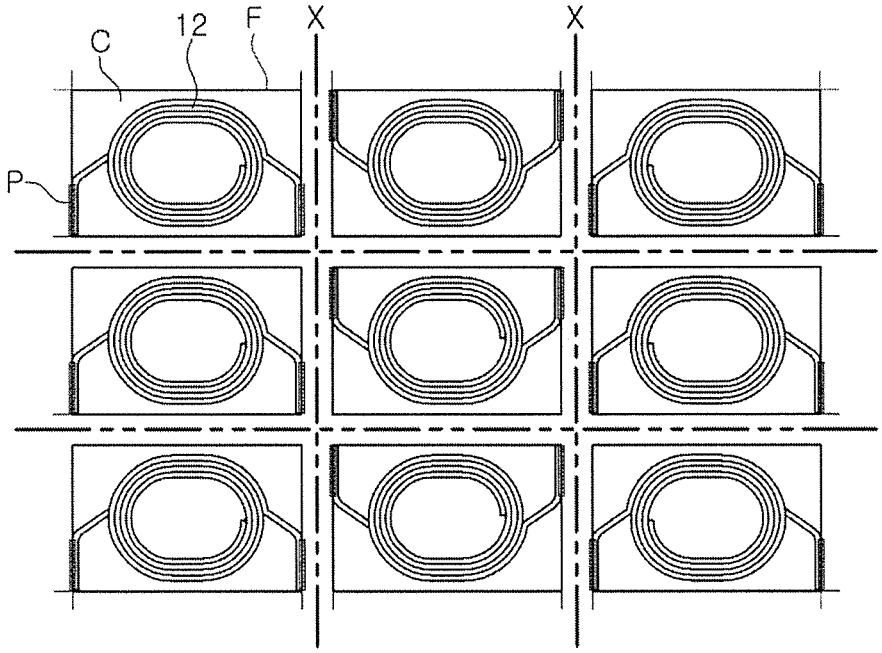
FIG. 4B is a view illustrating a process of strengthening fixing between a plurality of winding-type coils and a frame after the plurality of winding-type coils are arranged on the frame.

FIGS. 4A and 4B are views for explaining portions of a process of manufacturing the aforementioned winding-type inductor 100 or 100'. Specifically, FIG. 4A is a view illustrating a process of arranging a plurality of winding-type coils on a frame during a manufacturing process of manufacturing the winding-type inductor, and FIG. 4B is a view illustrating a process of strengthening the fixing between a plurality of winding-type coils and a frame after the plurality of winding-type coils are arranged on the frame.

First, referring to the top plane view of FIG. 4A, a frame F includes a plurality of cavities C, and the center of a core of the winding-type coil 12 is disposed on each of the plurality of cavities. A tape for temporarily fixing the winding-type coil 12 is disposed on a lower surface of each cavity. The winding-type coil 12 may be stably fixed to the frame F by the tape located on the lower surface of the cavity C. In this manner, since the winding-type inductors 12 are manufactured by seating the plurality of winding-type coils 12 in the plurality of cavities 12 within the frame F and subsequently performing dicing to form the winding-type coils 12 as individual chips, yield may be significantly improved.

Next, referring to the top plan view of FIG. 4B, in order to allow the winding-type coils 12 of FIG. 4B to be stably fixed to the frame F, laser welding is performed on copper Cu wrapping the first and second ends of the winding-type coils 12. That is, the first and second connection reinforcing portions connected to the first and second ends of the winding-type coils 12 may be formed through laser welding. In this case, since the tape is disposed on the lower surface of the frame F, a lower surface of the portion P to be welded when the laser welding is performed on the first and second ends is flat by the tape. When the fixing between the winding-type coil 12 and the frame F is strengthened through laser welding, distortion of the coil frequently occurs when a magnetic sheet is stacked and compressed on an upper surface and/or lower surface of the winding-type coil 12 may be prevented in advance and a contact area between the winding-type coil 12 and the external electrodes may be easily maximized even without applying separate copper pre-plating. Also, although not shown in detail, when dicing is performed along the X line of FIG. 4B after magnetic sheets are stacked on the upper surface and/or lower surfaces of the winding-type coil 12, bodies of individual winding-type inductors each including one winding-type coil 12 may be provided. In this case, as at least a portion of a laser-welded part and the magnetic sheet are cut through dicing, the first and second end surfaces of the body, the first and second side surfaces of the body, and the side surface of the welded part are formed as the cut surfaces.

In the case of the above-mentioned winding-type inductor 12, by reinforcing connectivity between the frames F introduced for mass-producing the winding-type coil 12 and the winding-type inductor, unnecessary distortion, defective matching of the winding-type coil 12, and the like, may be prevented in advance, and since defective separation between the winding-type coil 12 and the frame F is reduced, yield may be improved. In addition, since a contact area between the external electrodes and the winding-type coil 12 may be increased even without additional Cu pre-plating, durability may be strengthened and contact resistance may be reduced in a use environment of an actual product.

As set forth above, according to exemplary embodiments of the present disclosure, since the winding-type inductor in which the contact area between the winding-type coil and the external electrodes is increased is provided, an interfacial resistance of the winding-type inductor may be reduced and defective contact between the winding-type coil and the external electrodes may be solved.

While exemplary embodiments have been shown and described above, it will be apparent to those skilled in the art that modifications and variations could be made without departing from the scope of the present invention as defined by the appended claims.

What is claimed is:

1. A winding-type inductor comprising:

a body having a winding-type coil including a first end and a second end; and first and second external electrodes disposed on external surfaces of the body and electrically connected to the winding-type coil, wherein the first and second ends are exposed to the external surfaces of the body, first and second connection reinforcing portions are disposed on the first and second ends, respectively, the first and second connection reinforcing portions are directly connected to the first and second external electrodes, respectively, and end surfaces of the first and second connection reinforcing portions have a shape in which a lower surface thereof is flat and an upper surface thereof is curved.

2. The winding-type inductor of claim 1, wherein the external surfaces of the body to which the first and second connection reinforcing portions are exposed are first and second end surfaces opposing each other in a length direction of the body, and the first and second end surfaces are cut surfaces.

3. The winding-type inductor of claim 1, wherein an area of a cross-section of the first end is smaller than an area of a cross-section of the first connection reinforcing portion exposed to the external surface of the body, and an area of a cross-section of the second end is smaller than an area of a cross-section of the second connection reinforcing portion exposed to the external surface of the body.

4. The winding-type inductor of claim 1, wherein an upper surface of the first connection reinforcing portion is oriented in the same direction in which an upper surface of the second connection reinforcing portion is oriented, with respect to a thickness of the body.

5. The winding-type inductor of claim 1, wherein a cross-sectional area of a cross-section of the first connection reinforcing portion exposed to the external surface of the body is different from a cross-sectional area of a cross-section of the second connection reinforcing portion exposed to the external surface of the body.

6. The winding-type inductor of claim 1, wherein each of the first and second external electrodes includes a plurality of layers, the plurality of layers include at least an Ag-containing layer, an Ni-containing layer, and a Sn-containing layer, and the Ag-containing layer is physically in direct contact with the first and second connection reinforcing portions.

7. The winding-type inductor of claim 1, wherein the first and second connection reinforcing portions are positioned on an inner side of the external surfaces of the body and embedded by a magnetic material within the body.

8. The winding-type inductor of claim 7, wherein the first and second connection reinforcing portions have a semicircular structure in which a lower surface is flat and an upper surface is convex within the body.

9. The winding-type inductor of claim 1, wherein the body includes a stacking structure formed by stacking a plurality of magnetic sheets, and the winding-type coil is embedded within the stacking structure.

10. The winding-type inductor of claim 9, wherein the plurality of magnetic sheets are formed of a composite of a resin and magnetic powder, and the magnetic powder is dispersed in the resin.

* * * * *